United States Patent [19]

Howell

[11] 4,311,282

[45] Jan. 19, 1982

[54] AGRICULTURAL GRINDER MIXERS

[75] Inventor: Robert M. Howell, Glen Waverley, Australia

[73] Assignee: Sperry Corporation, New Holland, Pa.

[21] Appl. No.: 223,598

[22] Filed: Jan. 9, 1981

Related U.S. Application Data

[63] Continuation of Ser. No. 62,392, Jul. 31, 1979, abandoned, Continuation of Ser. No. 62,392, Jul. 31, 1979, abandoned.

[51] Int. Cl.[3] ..... B02C 13/286

[52] U.S. Cl. ..... 241/56; 241/57; 241/101 B; 241/186 A; 366/306

[58] Field of Search ..... 406/50, 57–59; 198/497–499, 494, 671; 366/603, 306, 186, 196; 241/167, 101.7, 101 B, 186 R, 186 A, 260.1, 261, 190, 247, 82.1, 82.5, 82.6, 82.7, 101 A, 56, 57

[56] References Cited

U.S. PATENT DOCUMENTS

| | | | |
|---|---|---|---|
| 1,607,713 | 11/1926 | Wickey | 198/498 |
| 1,659,499 | 2/1928 | Sedberry | 241/186 A X |
| 3,221,999 | 12/1965 | Cumpston, Jr. | 241/260.1 X |

*Primary Examiner*—Mark Rosenbaum

*Attorney, Agent, or Firm*—James R. Bell; Frank A. Seemar

[57] ABSTRACT

Hammer mill cyclone outlet is disclosed for a grinder/-mixer agricultural machine, including a hammer mill, a transfer auger and a fan for removal of airborne dust generated by the mill. The fan communicates with the mill via a duct, the mouth of the duct opening into the mill is partially covered by a resilient flap and engages with the flights of the transfer auger to move and thus prevent a build up of stationary obstructions at the mouth.

4 Claims, 3 Drawing Figures

AGRICULTURAL GRINDER MIXERS

This is a continuation of application Ser. No. 62,392, filed July 31, 1979, now abandoned.

BACKGROUND OF THE INVENTION

1. Field of Invention

The present invention relates to an agricultural grinder mixer and more particularly to the operation of the hammer mill and the removal of ground fines of milled material.

2. Description of Prior Art

Grinder mixers known to Applicants employ a large mixing tank mounted on a mobile frame. Forwardly of the mixing tank a hammer mill is fixed to the frame for receiving grain of various descriptions which is ground and cut to small size and then transferred to the mixing tank by a transfer auger. Such grinder mixers are described in greater detail in prior U.S. Pat. Nos. 3,780,993 and 3,997,146.

The hammer mill includes an exhaust fan arrangement for removing dust and other airborne particles that are produced during the milling process. The particles after separation from the air are allowed to fall into the transfer auger or are otherwise transmitted to the mixing tank.

The milled material falls onto the bottom of the mill into a transfer auger mounted therein where the material is transferred to the mixer. The duct for removal of airborne material is connected to the exhaust fan and is arranged near the bottom of the mill at or near the end of the transfer auger.

It has been found with this conventional arrangement that blockages are mainly caused by pieces of straw lodging in the mouth of the duct around which duct other particles accumulate eventually resulting in a blockage of the duct. This blockage results in reduced air flow in the duct and to the cyclone thereby resulting in increased discharge of fine material from the cyclone exhaust. This leads to pollution of the atmosphere around the machine leading to discomfort of the operators.

The blockage can only be cleared by stopping the machine and manually clearing the debris from the duct. Such blockages occur frequently in some conditions and result in considerable down time of the equipment.

SUMMARY OF THE INVENTION

The object of the present invention is to eliminate or substantially reduce the number of blockages occurring in the exhaust duct of hammer mills.

This is carried out according to the invention in a simple manner by providing in a hammer mill having an exhaust duct for airborne material, a flap member mounted to extend over the mouth of the exhaust duct so that the free edge of the flap is closely adjacent to or in contact with a flight of a transfer auger of the hammer mill, the flap being effecting to prevent a lodgement of obstructions in the duct mouth thereby reducing the likelihood of duct blockages.

The invention will now be described having reference to the accompanying drawings in which:

DESCRIPTION OF THE PREFERRED EMBODIMENTS

Figure 1:
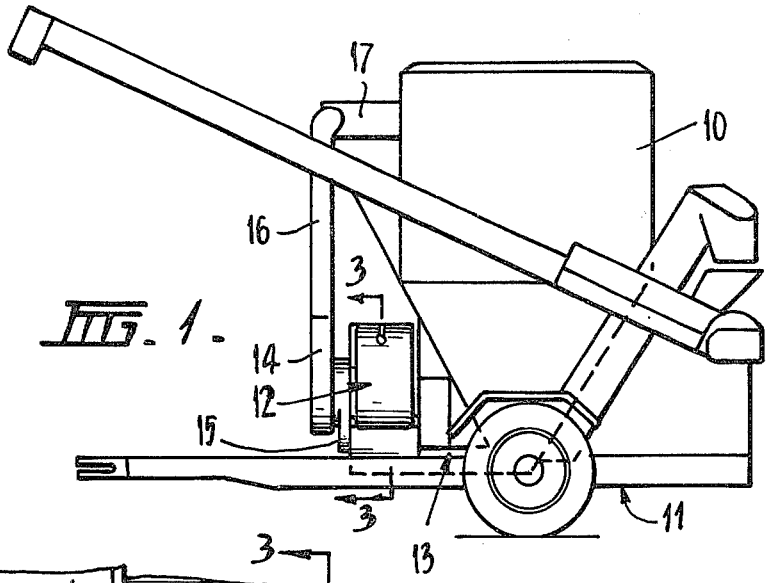
FIG. 1 is a side view of a typical grinder/mixer machine.

Referring to FIG. 1, a grinder/mixer machine is shown having a mixing tank 10 mounted on a wheeled chassis 11 and including a hammer mill 12. The hammer mill is connected to the tank 10 by an enclosed transfer auger generally shown at 13. A fan 14 is provided connecting to inlet and outlet ducts 15,16. The fines are delivered to a cyclone 17 and the heavier particles are separated from dust and delivered to the transfer auger 22 whilst the dust is exhausted to atmosphere.

Figure 2:
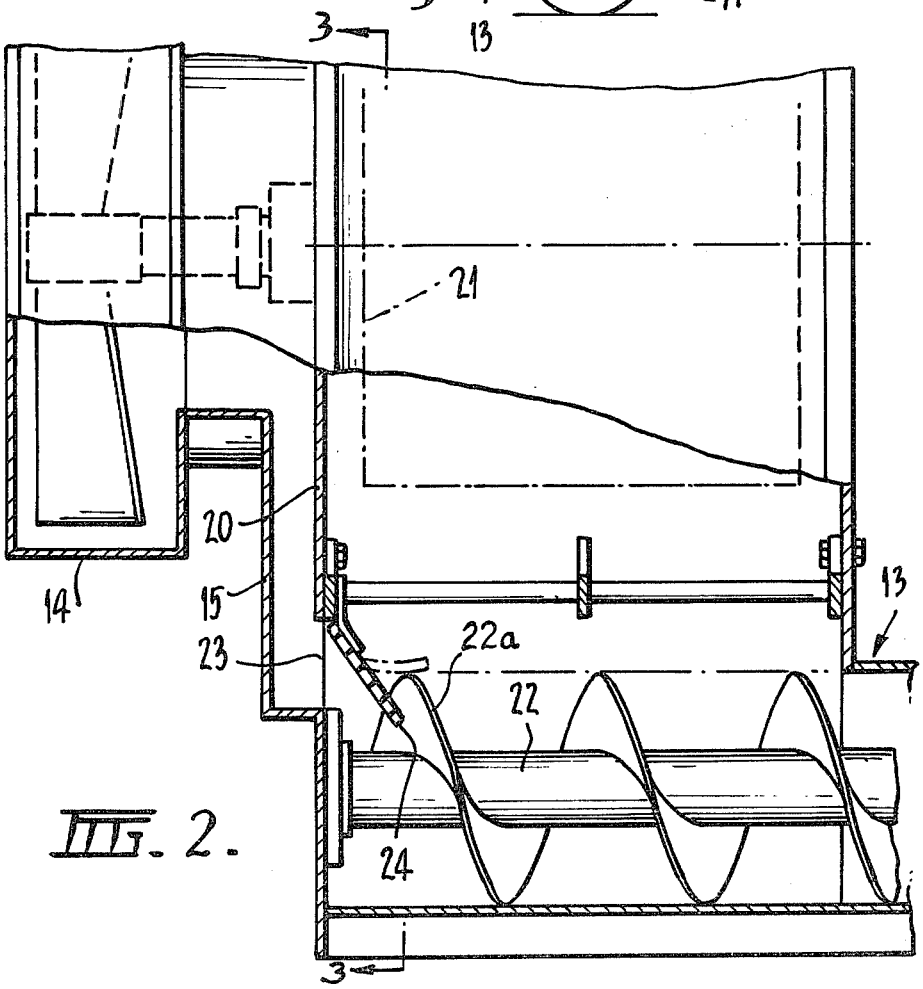
FIG. 2 is a part sectional view of a hammer mill taken on line 2—2 in FIG. 3.
Figure 3:
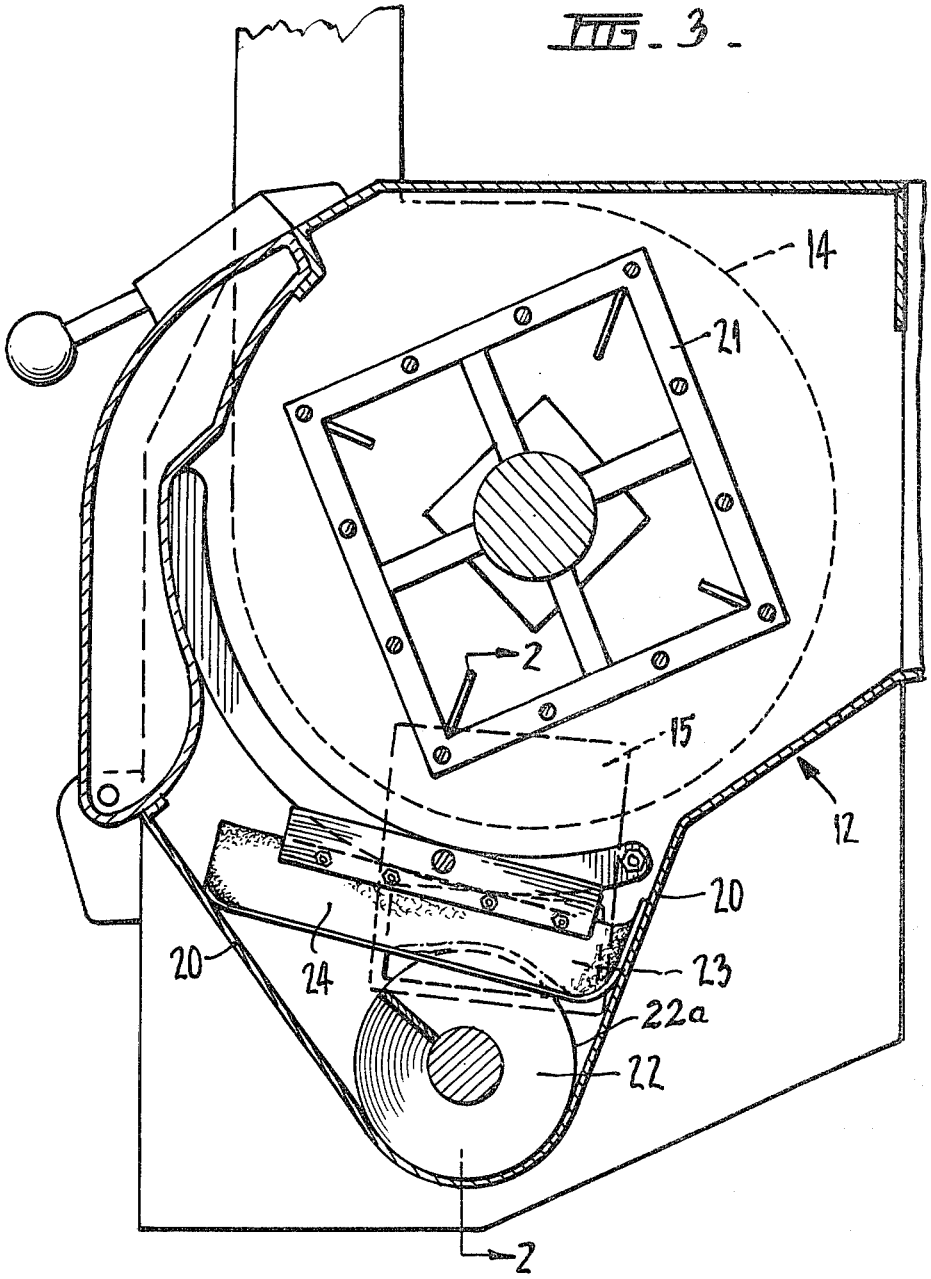
FIG. 3 is a part sectional view of a hammer mill taken on line 3—3 in FIG. 2.

Referring specifically to FIGS. 2 and 3, these figures show in detail a practical arrangement of the present invention.

The hammer mill 12 comprises a container 20 housing a milling device 21 and a transfer auger 22 mounted beneath the milling device and extending across the container to carry milled material into the mixing tank in known manner.

The fan 14 is connected by duct 15 to the foot of the milling container 20 having its mouth 23 positioned adjacent the transfer auger. The fan intended to create an air draft in the container and carry fine airborne into the duct 15 through mouth 23.

According to the invention a resilient flap 24 is positioned and mounted over the mouth 23 of the duct 15 to extend outwardly and downwardly as shown. The edge of the flap is intended to engage flight of the transfer auger 22 so that is use the rotating flights cause the flap to flex up and down, in and out.

It has been found that this simple and unique device will effectively dislodge obstructions such as pieces of straw and like material from gathering around the mouth of the duct. Such obstructions tend to cause a build up of fine material around the obstruction eventually leading to a blockage of the duct mouth 23 and ensuing increase in airborne dust in the hammer mill and ineffective operation of the cyclone leading to discomfort for the operator.

The flap of the invention ensures that an obstruction that comes up again will be moved in unison with movement of the flap caused by its contact with the auger and thereby prevent build up of dust around the moving obstruction.

In one practical arrangement the mouth 23 of the duct is of rectangular cross-section extending across the width of the transfer auger 22 and just above the upper line of the auger flights.

I claim:

1. A grinder-mixer comprising:

means for processing grain by grinding said grain to produce milled material, said milled material containing dust and other airborne material, said means for processing including a hammermill;

a mixing tank portion of the grinder-mixer;

means for receiving and moving said milled material to said mixing tank, said means for receiving including an auger portion of the grinder-mixer connected adjacent the mill, said auger having rotatable flights;

means for exhausting said dust from said milled material in said auger portion to atmosphere, said means including an exhaust fan connected in an exhaust duct, said duct having a mouth adjacent said auger; said means for dislodging said dust from said mouth, said means including a flap having a stationary first portion mounted adjacent said mouth and a second portion movable relative to said mouth in response to rotation of said auger causing repetitive engagement with said rotating auger flights.

2. The grinder-mixer of claim 1 wherein said first portion is connected adjacent said mouth and said second portion extended angularly relative to said mouth and terminating in spaced relationship with said mouth.

3. The grinder-mixer of claim 2 wherein said flap is of flexible material.

4. The grinder-mixer of claim 1 wherein said first portion is connected adjacent said mouth and said second portion extends toward said flights, said second portion being flexible and terminating in overlapping relationship with said flights.

* * * * *